US006655785B1

(12) United States Patent
Hilton et al.

(10) Patent No.: US 6,655,785 B1
(45) Date of Patent: Dec. 2, 2003

(54) PRINT ELEMENT AND METHOD FOR ASSEMBLING A PRINT HEAD

(75) Inventors: Brian S. Hilton, Rochester, NY (US); Arthur J. Sobon, Rochester, NY (US); Steven R. Moore, Rochester, NY (US); David S. Derleth, Webster, NY (US); Richard C. Keefe, Savannah, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/382,886

(22) Filed: Aug. 25, 1999

(51) Int. Cl.[7] ..... B41J 2/175
(52) U.S. Cl. ..... 347/49; 347/18
(58) Field of Search ..... 347/49, 84, 85, 347/86, 87, 17, 18, 37, 50, 108, 109; 29/890.1

(56) References Cited

U.S. PATENT DOCUMENTS

| | | | | | |
|---|---|---|---|---|---|
| 4,633,274 | A | | 12/1986 | Matsuda | 347/50 |
| 4,695,854 | A | | 9/1987 | Cruz-Uribe | 347/40 |
| 4,934,961 | A | | 6/1990 | Piorunneck et al. | 439/637 |
| 4,940,998 | A | * | 7/1990 | Asakawa | 347/37 |
| 4,970,533 | A | | 11/1990 | Saito et al. | 346/14 R |
| 5,049,904 | A | * | 9/1991 | Nakamura et al. | 347/49 |
| 5,119,115 | A | * | 6/1992 | Buat et al. | 347/86 |
| 5,297,336 | A | | 3/1994 | Burolla | 29/890.1 |
| 5,519,425 | A | | 5/1996 | Dietl et al. | 347/87 |
| 5,552,816 | A | * | 9/1996 | Oda et al. | 347/86 |
| 5,565,900 | A | * | 10/1996 | Cowger et al. | 347/42 |
| 5,659,345 | A | * | 8/1997 | Altendorf | 347/87 |
| 5,739,830 | A | * | 4/1998 | John et al. | 347/49 |
| 5,771,052 | A | * | 6/1998 | Hine et al. | 347/42 |
| 5,880,754 | A | * | 3/1999 | Niikura et al. | 347/18 |
| 5,959,647 | A | * | 9/1999 | Claramunt et al. | 347/49 |
| 6,000,789 | A | * | 12/1999 | Takagi et al. | 347/86 |
| 6,024,441 | A | * | 2/2000 | Nishimoto | 347/85 |
| 6,130,695 | A | * | 10/2000 | Childers et al. | 347/85 |
| 6,179,415 | B1 | * | 1/2001 | Okazaki et al. | 347/86 |
| 6,206,510 | B1 | * | 3/2001 | Casserino et al. | 347/84 |
| 6,224,192 | B1 | * | 5/2001 | Robinson et al. | 347/49 |
| 6,343,848 | B2 | * | 2/2002 | Berg et al. | 347/18 |

FOREIGN PATENT DOCUMENTS

| | | | | |
|---|---|---|---|---|
| EP | 0 672 528 A2 | | 9/1995 | |
| EP | 765757 A2 | * | 2/1997 | B41J/2/175 |
| JP | 409286115 A | * | 11/1997 | B41J/2/177 |
| WO | PCT/91/08112 | | 6/1991 | |
| WO | WO-9108112 | * | 6/1991 | B41J/2/135 |

OTHER PUBLICATIONS

Frank Cost, Pocket Guide to Digital Printing, 1997, Delma Publishers, p. 99.*
European Search Report, Jul. 11, 2001, 5 pages.

* cited by examiner

*Primary Examiner*—Stephen D. Meier
*Assistant Examiner*—Blaise Mouttet
(74) *Attorney, Agent, or Firm*—Perman & Green, LLP

(57) ABSTRACT

A print element including a heat sink, a printed wiring member mounted on the heat sink, a thermal ink jet assembly mounted to the heat sink, and a manifold assembly mounted to the heat sink. The manifold assembly has a first mount for removably connecting a first source of ink to the manifold assembly and a first outlet to the thermal ink jet assembly. The print element can be combined with a housing to form a print head in a first type of printing device or can be used without the housing in a second different printing device.

15 Claims, 11 Drawing Sheets

FIG. 6
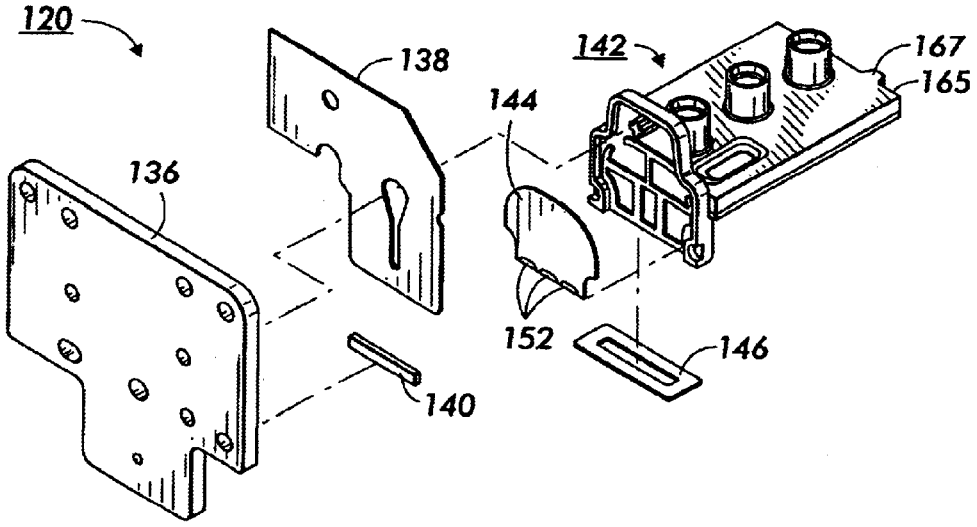
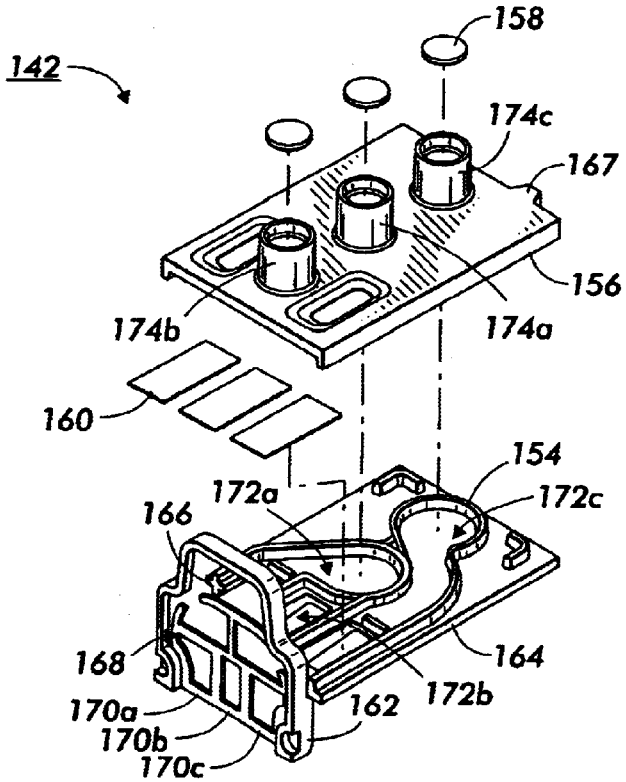
FIG. 7

FIG. 8A
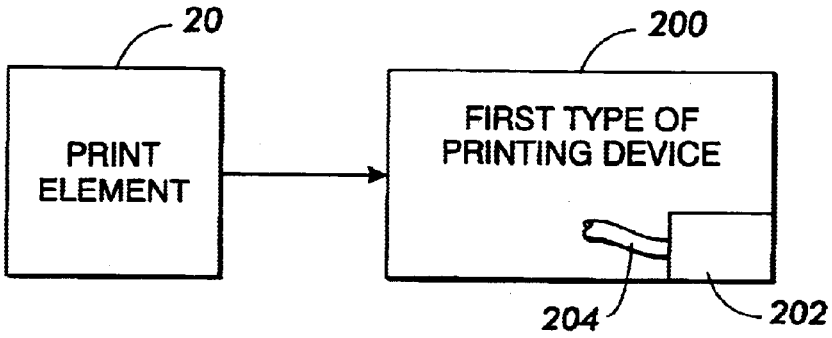
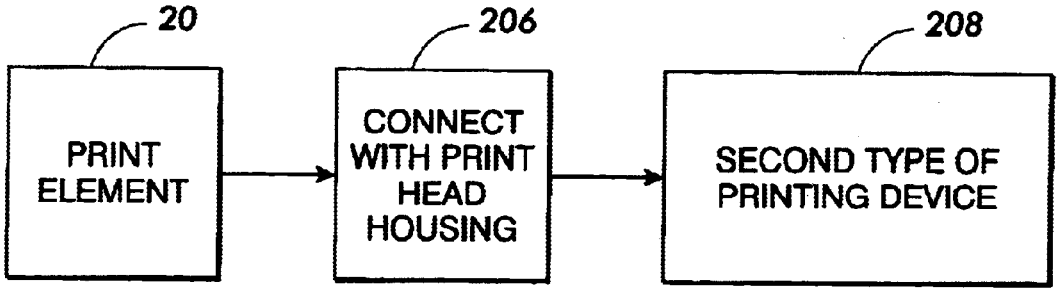
FIG. 8B

FIG. 11
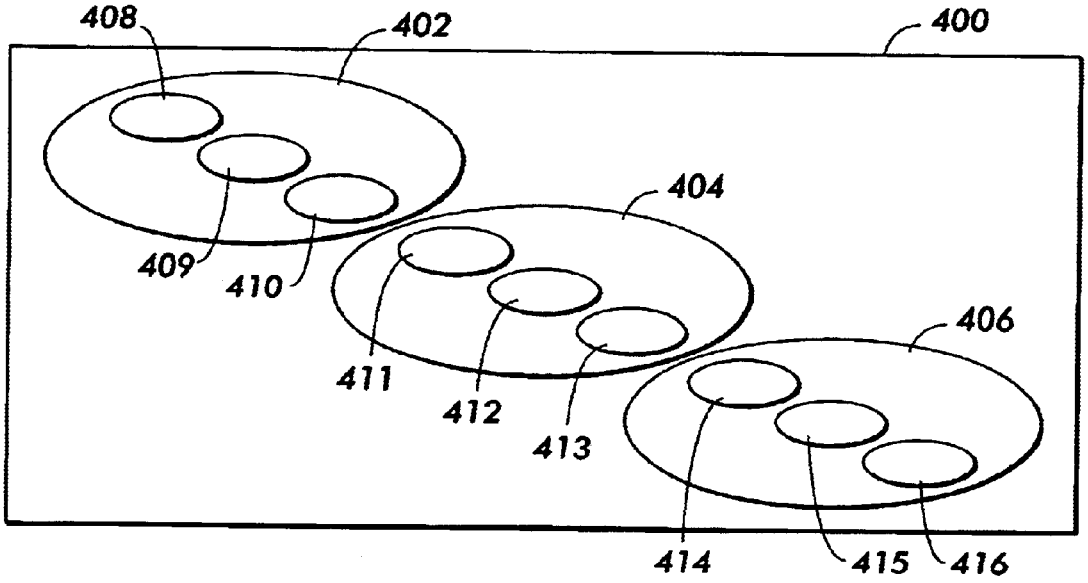
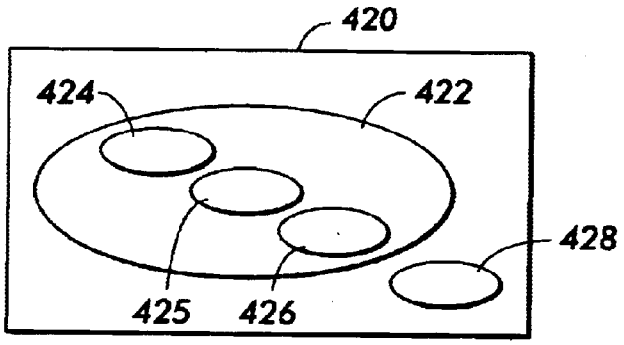
FIG. 12

PRINT ELEMENT AND METHOD FOR ASSEMBLING A PRINT HEAD

BACKGROUND OF THE INVENTION

1. Field of the Invention

The present invention relates to a print element for a thermal ink jet printing apparatus and, more particularly, to a print element which can be used in different printing apparatus and with different types of ink supplies.

2. Prior Art

U.S. Pat. Nos. 5,297,336 and 5,519,425 disclose an ink manifold formed with an ink supply into a unitary ink supply cartridge for a thermal ink jet printer. U.S. Pat. No. 4,695,854 discloses an external manifold for an ink jet array.

SUMMARY OF THE INVENTION

In accordance with one embodiment of the present invention a print element is provided comprising a heat sink, a printed wiring member, a thermal ink jet assembly, and a manifold assembly. The printed wiring member is mounted on the heat sink. The thermal ink jet assembly is mounted to the heat sink. The manifold assembly is connected to the heat sink and the thermal ink jet assembly. The manifold assembly comprises a first mount for removably connecting a first source of ink to the manifold assembly and a first outlet to the thermal ink jet assembly.

In accordance with another embodiment of the present invention a print head is provided comprising a housing and a print element. The housing has a receiving area for removably receiving at least one ink tank. The print element is connected to the housing and has a heat sink, a thermal ink jet assembly, and a manifold assembly. The manifold assembly has at least one mount for removably connecting the ink tank to the manifold assembly. The housing has an aperture. The manifold assembly extends through the aperture.

In accordance with another embodiment of the present invention, a print head assembly is provided comprising a carriage and two print heads connected to the carriage. Each print head has a housing and a print element connected to the housing. Each print element has a heat sink and an ink manifold assembly mounted to the heat sink and an ink jet assembly. A portion of the ink manifold assemblies are located in their respective housing receiving areas and the heat sinks are located at exterior sides of the housings and located between the two housings.

In accordance with one method of the present invention a method of manufacturing ink jet printing components is provided comprising steps of assembling a print element and optionally connecting the print element to a print head housing. The method of assembling a print element comprises steps of connecting a thermal ink jet assembly to a heat sink; connecting a printed wiring member to the heat sink; and connecting an ink manifold assembly to the heat sink and the thermal ink jet assembly. The print head housing has a receiving area for removably receiving an ink tank. The print element can be assembled in a first type of printing device without the print head housing and, a combined assembly of the print element and the print head housing can be assembled in a second type of printing device.

BRIEF DESCRIPTION OF THE DRAWINGS

The foregoing aspects and other features of the present invention are explained in the following description, taken in connection with the accompanying drawings, wherein:

FIG. 6 is an exploded perspective view of the print element shown in FIG. 5;

FIG. 7 is an exploded perspective view of the ink manifold assembly used in the print element shown in FIG. 6;

FIGS. 8A and 8B are schematic diagrams of methods of using a same type of print element in two different types of printing devices;

FIGS. 11–13 schematic diagrams of examples of alternate embodiments of how print elements can be grouped.

DETAILED DESCRIPTION OF THE PREFERRED EMBODIMENT

Figure 1:
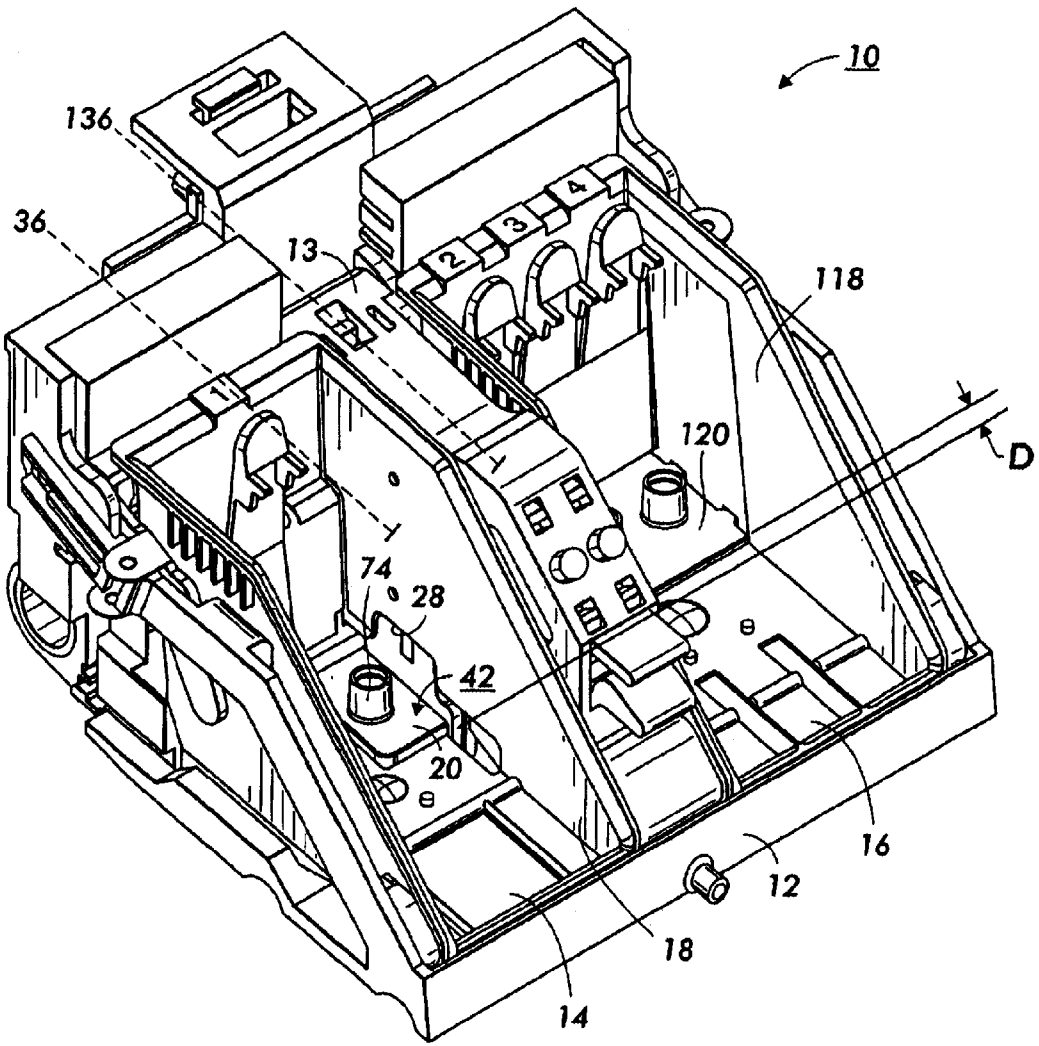
FIG. 1 is a perspective view of a print head assembly comprising features of the present invention.

Referring to FIG. 1, there is shown a perspective view of a print head assembly 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The print head assembly 10 generally comprises a carriage 12 and two print heads 14,16 mounted to the carriage 12. The carriage 12 is intended to be movably mounted on a frame of a printing device, such as a thermal ink jet printer, for reciprocating lateral sliding movement on the frame as is generally known in the art. In this embodiment the first print head 14 is intended to be a black ink print head and the second print head 16 is intended to be a color ink print head. However, in the alternate embodiments, the print head assembly configuration could be varied, such as a carriage with only a single black ink print head, a carriage with multiple black ink print heads, a carriage with multiple color print heads, or any other suitable configuration.

Figure 2:
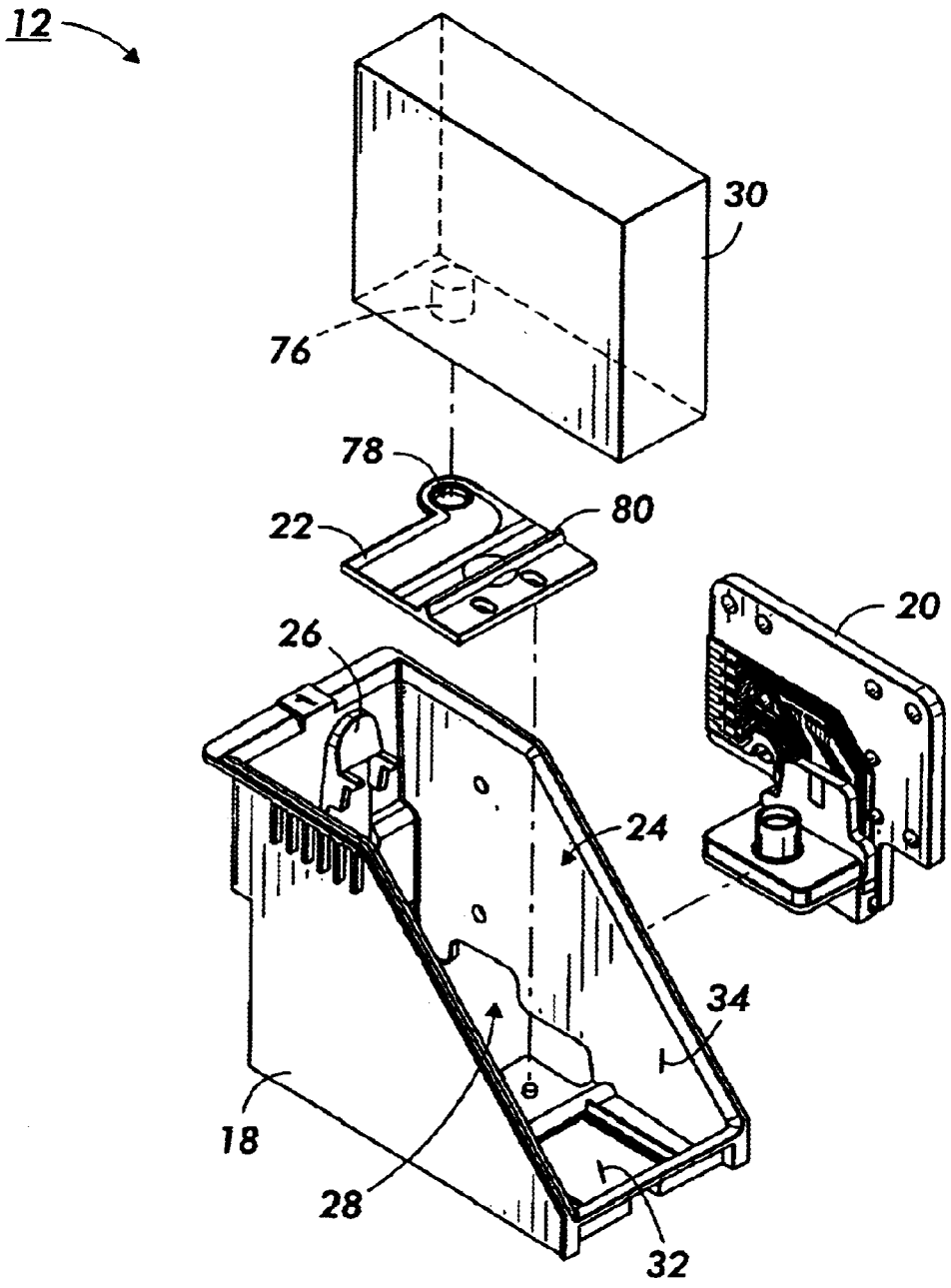
FIG. 2 is an exploded perspective view of one of the print heads used in the assembly shown in FIG. 1.

Referring also to FIG. 2, the first print head 14 generally comprises a housing 18, a print element 20, and a seal member 22. The housing 18 is preferably a one-piece molded plastic member. In this embodiment the housing 18 comprises a receiving area 24, an integrally formed resilient latch 26, substantially open top and front ends, and an aperture 28 extending through the housing. The receiving area 24 is suitably sized and shaped to removably receive an ink supply cartridge or tank 30. The tank 30 can be inserted into and removed from the receiving area 24 through the substantially open top and front ends of the housing 18. The latch 26 is configured to resiliently snap-lock latch the tank 30 inside the receiving area 24. The latch 26 can deflect in a general cantilever fashion. A user can deflect the top end of the latch 26 rearward for removing or unlatching the tank 30 from the housing 18. In alternate embodiments any suitable type of latching or mounting mechanism could be used to fix the tank 30 with the housing 18. In this embodiment the aperture 28 extends through a corner of the housing 18; through portions of the bottom wall 32 and the right side wall 34. However, in alternate embodiments the aperture could extend merely through the bottom wall 32 or through any one or more of the side walls of the housing 18.

Figure 3:
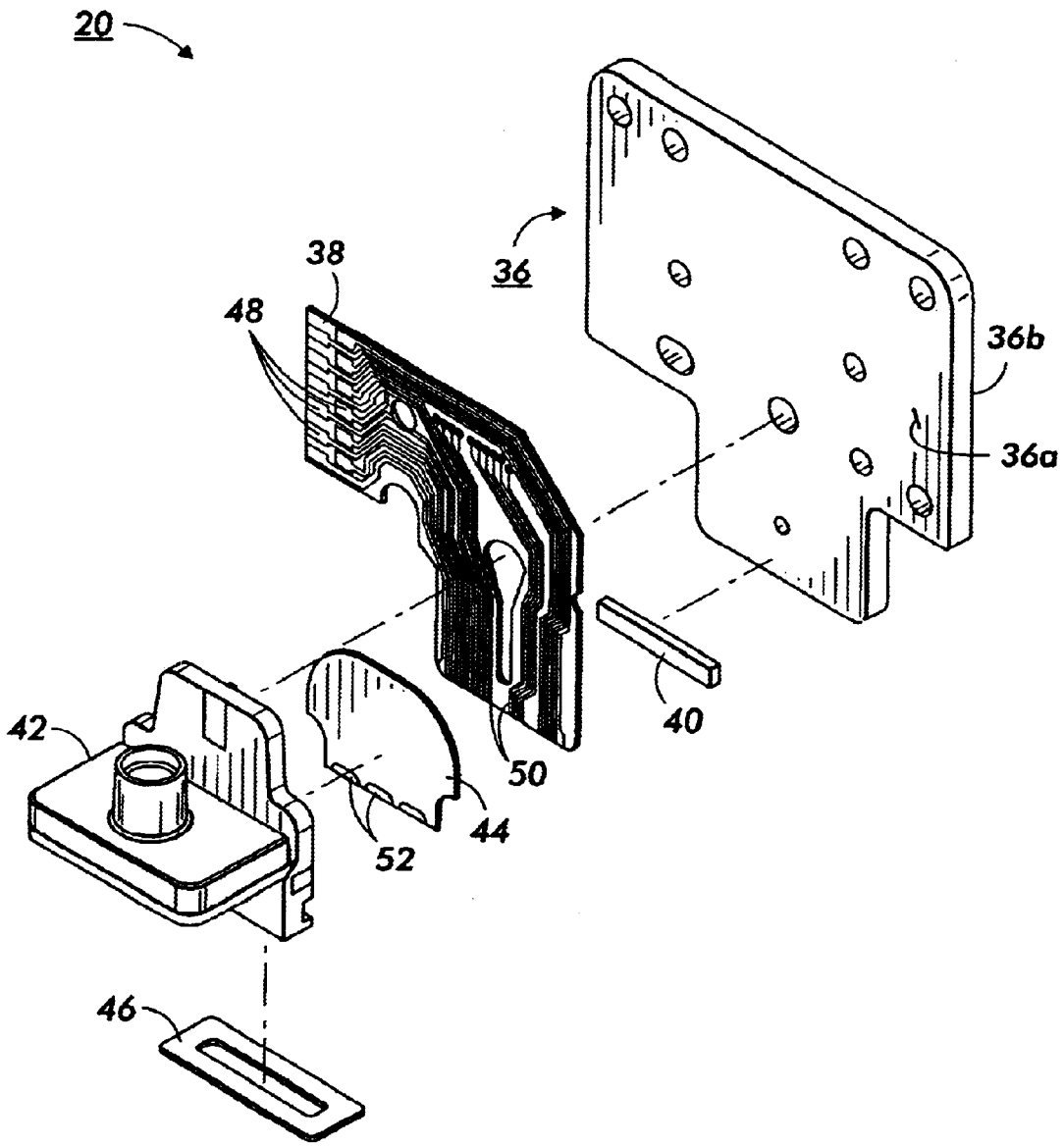
FIG. 3 is an exploded perspective view of the print element shown in FIG. 2.

Referring also to FIG. 3, the print element 20 generally comprises a heat sink 36, a printed wiring member 38, a thermal ink jet assembly 40, an ink manifold assembly 42, a fluid seal 44, and a facetape 46. In this embodiment the print elements have thermal ink jet assemblies. However, features of the present invention could be used without a heat sink and with a piezoelectric ink jet assembly, an acoustic ink jet assembly, a thermal wax printer, or any other suitable liquid ink printing device. The heat sink 36 is preferably a flat one-piece member, such as aluminum. The printed wiring member 38 includes electrically conductive traces on a substrate with contact pads 48 at one end and contact areas 50 at an opposite end. The printed wiring member 38 is fixedly attached directly on the heat sink 36 with the contact pads 48 at a rear end edge and the contact areas 50 at a bottom end edge. Thus, the member 38 has a general right angle or L-shaped configuration. The rear end of the heat sink 36 and the contact pads 48 are sized and shaped to be connected to an electrical connector, similar to a card edge connector, such as disclosed in U.S. Pat. No. 4,934,961 which is hereby incorporated by reference, but as a single row of contacts on one side of the card edge receiving area. However, any suitable electrical connection could be made. The member 38 also has holes therethrough for mounting posts of the ink manifold assembly 42 to extend through. The posts can extend into holes in the heat sink 36 for mounting the ink manifold assembly 42 to the heat sink 36. The thermal ink jet assembly 40 is fixedly attached to the side of the heat sink 36 at its bottom end edge. The ink jet assembly 40 is also operably connected to the contact areas 50 of the printed wiring member 38. The fluid seal 44 covers a side of the ink manifold assembly 42 and has slots 52 for ink to flow from an outlet of the ink manifold assembly 42 to the ink jet assembly 40. In the embodiment shown, the printed wiring member 38, ink jet assembly 40, and ink manifold assembly 42 are mounted to one side 36*a* of the heat sink 36. In an alternate embodiment mirror image components of these members 38, 40, 42 (or their equivalent) could be mounted to the opposite side 36*b* of the heat sink 36. Thus, the contact pads 48 could be located at a first location (on side 36*a*) or optimally located at a second different location (on side 36*b*). In another alternate embodiment, two sets of the members 38, 40, 42 could be mounted to the one member 36; one set on each side 36*a*, 36*b*.

Figure 4:
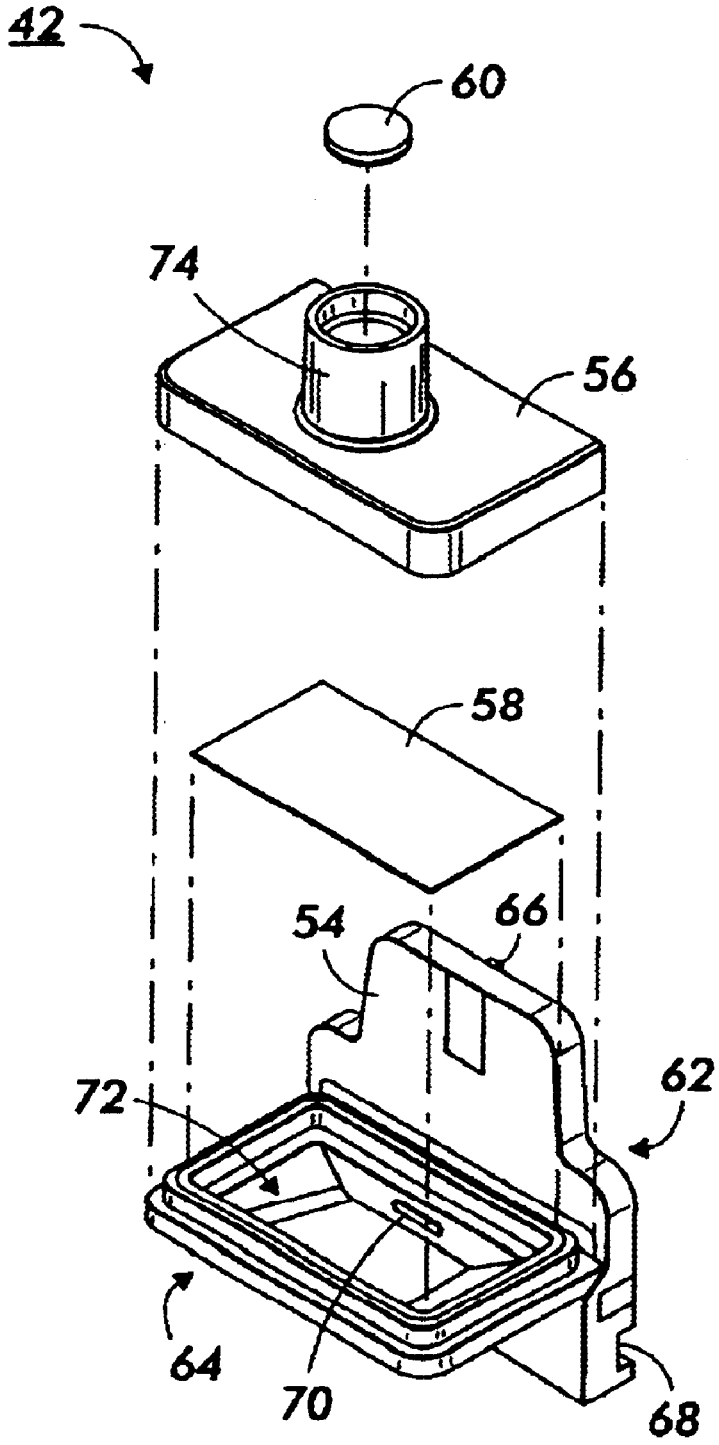
FIG. 4 is an exploded perspective view of the ink manifold assembly used in the print element shown in FIG. 3.

Referring also to FIG. 4, the ink manifold assembly 42 generally comprises a base member 54, a cover 56, and two filters 58, 60. The base member 54 and cover 56 are preferably comprised of molded plastic. The base member 54 generally comprises a first section 62 and a second section 64. The first section 62 includes mounting post 66 (only one of which is shown), a recess 68 for receiving and supporting the ink jet assembly 40, and an outlet 70 through the first section 62. The second section 64 extends generally perpendicularly from the first section 62. The second section 64 has an ink well 72 which receives the first filter 58 and is in communication with the outlet 70. The cover 56 is mounted on the second section 64 with the first filter 58 being sandwiched therebetween. The cover 56 includes a mount 74 extending upward from its top side. The second filter 60 is mounted inside the mount 74. The second filter 60 is a coarser filter then the first filter 58. The mount 74 is sized and shaped to extend into a receiving hole 76 in the ink tank 30(see FIG. 2). The mount 74 is also suitably sized and shaped to have a hose or conduit (not shown) from a different type of ink supply mounted thereon around the outer perimeter of the mount. The mount 74 extends generally parallel relative to the heat sink 36.

In order to form the first print head 14 the print element 20 is manufactured and then connected to the housing 18. The housing 18 has mounting posts (not shown) on the exterior of its right side that extend into holes of the heat sink 36 and mount the heat sink 36 on the exterior of the right side of the housing 18. The ink manifold assembly 42 extends through the aperture 28 into the receiving area 24. The seal member 22 is placed against the interior bottom wall 32 of the housing 18 with the mount 74 extending through the hole 78 (see FIG. 2). The seal member 22 is preferably comprised of an elastomeric material and includes a resilient upwardly facing ridge 80. The ridge 80 functions as a spring. The ridge 80 is resiliently compressed or deflected when the tank 30 is inserted into the receiving area 24 and helps to distribute some of the mounting load, from the tank 30 being placed into the receiving area 24, onto the housing 18 rather than all of the load being placed against the mount 74 and the print element 20. The spring feature of the ridge 80 also biases the ink tank 30 towards the latch 26 to stabily hold the tank 30 with the print head 14 with minimal forces being exerted against the print element 20 and the otherwise undesired resultant movement of the ink jet assembly 40, during ink tank loading.

Figure 5:
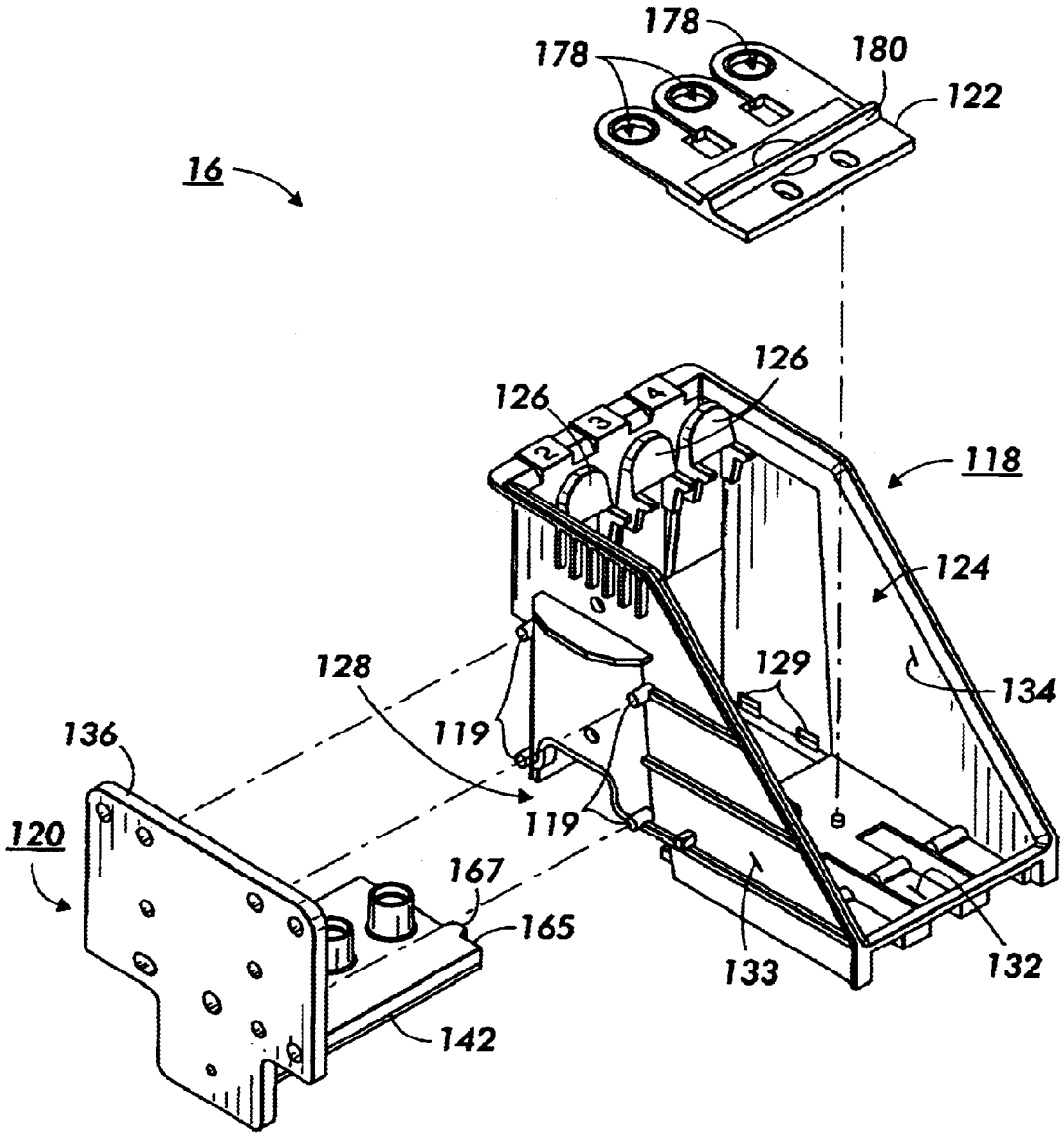
FIG. 5 is an exploded perspective view of the other print head used in the assembly shown in FIG. 1.

Referring to FIGS. 1 and 5, the second print head 16 generally comprises a housing 118, a print element 120, and a seal member 122. The housing 118 is preferably a one-piece molded plastic member. In this embodiment the housing 118 comprises a receiving area 124, three integrally formed resilient latches 126, substantially open top and front ends, and an aperture 128 extending through the housing. The receiving area 124 is suitably sized and shaped to removably receive three ink supply cartridges or tanks similar to the black ink tank 30, but smaller in width and having color inks. The tanks can be inserted into and removed from the receiving area 124 through the substantially open top and front ends of the housing 118. The latches 126 are configured to resiliently snap-lock latch the tanks inside the receiving area 124. The latches 126 can deflect in a general cantilever fashion. A user can manually deflect the top end of the latches 126 rearward for removing or unlatching the tanks from the housing 118. In alternate embodiments any suitable type of latching or mounting mechanism could be used to fix the tanks with the housing 118. In this embodiment the aperture 128 extends through a corner of the housing 118 and through portions of the bottom wall 132 and the left side wall 133. However, in alternate embodiments the aperture could extend merely through the bottom wall 132 or through any one or more of the side walls of the housing 118.

Referring also to FIG. 6, the print element 120 generally comprises a heat sink 136, a printed wiring member 138, a thermal ink jet assembly 140, an ink manifold assembly 142, a fluid seal 144, and a facetape 146. The heat sink 136 is preferably a flat one-piece member, such as aluminum.

Preferably, the heat sink 136 is exactly the same as the heat sink 36, but could be different. The printed wiring member 138 includes electrically conductive traces on a substrate with contact pads at a rear end and contact areas at an opposite bottom end. The printed wiring member 138 is fixedly attached directly on the heat sink 136 with the contact pads at a rear end edge and the contact areas at a bottom end edge. Thus, the member 138 has a general right angle or L-shaped configuration. The rear end of the heat sink 136 and the contact pads of the member 138 are preferably designed to have a card edge type of electrical connector removably mounted thereon similar to the heat sink 36 and contact pads 48. In an alternate embodiment a single electrical connector can be mounted on the rear end of both heat sinks 36, 136 and electrically connected to both sets of contact pads. The member 138 also has holes therethrough for mounting posts of the ink manifold assembly 142 to extend through. The posts can extend into holes in the heat sink 136 for mounting the ink manifold assembly 142 to the heat sink 136. The thermal ink jet assembly 140 is fixedly attached to the side of the heat sink 136 at its bottom end edge. The ink jet assembly 140 is also operably connected to the contact areas of the printed wiring member 138. The fluid seal 144 covers a side of the ink manifold assembly 142 and has slots 152 for ink to flow from outlets of the ink manifold assembly 142 to the ink jet assembly 140.

Referring also to FIG. 7, the ink manifold assembly 142 generally comprises a base member 154, a cover 156, and two types of filters 158, 160. The base member 154 and cover 156 are preferably comprised of molded plastic. The base member 154 generally comprises a first section 162 and a second section 164. The first section 162 includes mounting post 166, a recess 168 for receiving and supporting the ink jet assembly 140, and three outlets 170*a*, 170*b*, 170*c* through the first section 162. The second section 164 extends generally perpendicularly from the first section 162 with three ink wells 172*a*, 172*b*, 172*c* which receive the filters 160 and are in communication with the outlets 170. The cover 156 is mounted on the second section 164 with the filters 160 being sandwiched therebetween. The cover 156 includes three mounts 174*a*, 174*b*, 174*c* extending upward from its top side. The filters 158 are mounted inside the mounts 174. The filters 158 are coarser filters than the filters 160. The mounts 174 are sized and shaped to extend into a receiving hole in the ink tanks (similar to FIG. 2). The mounts 174 are also suitably sized and shaped to have a hose or conduit (not shown) from a different type of ink supply mounted thereon around the outer perimeter of the mounts. The mounts 174 extends generally parallel relative to the heat sink 136.

In order to form the second print head 16 the print element 120 is manufactured and then connected to the housing 118. The housing 118 has mounting posts 119 on the exterior of its left side 133 that extend into holes of the heat sink 136 and mount the heat sink 136 to the exterior of the left side of the housing 118. The ink manifold assembly 142 extends through the aperture 128 into the receiving area 124. The seal member 122 is placed against the interior bottom wall of the housing 118 with the mounts 174 extending through holes 178. The seal member 122 is preferably comprised of an elastomeric material and includes a resilient upwardly facing ridge 180. The ridge 180 functions as a spring. The ridge 180 is resiliently compressed or deflected when the tanks are inserted into the receiving area 124 and helps to distribute some of the mounting load, from the tanks being placed into the receiving area 124, onto the housing 118 rather than all of the load being placed against the mounts 174 and the print element 120. The spring feature of the ridge 180 also biases the ink tanks towards the latches 126 to stabily hold the tanks with the print head 16 with minimal forces being exerted against the print element 120 and the otherwise undesired resultant movement of the ink jet assembly 140, during ink tank loading. In this embodiment the housing 118 also has notches 129 in its right side 134. The distal end 165 of the manifold assembly 142 had projections 167. When the print element 120 is mounted to the housing 118, the projections 167 extend into the notches 129 to stabily mount the distal end 165 to the housing 118.

Referring back to FIG. 1, the first print head 14 is positioned on the left side of the carriage 12 and the second print head 16 is positioned on the right side of the carriage 12. The two heat sinks 36, 136 are, thus, located next to each other between the two housings 18, 118 under the section 13 of the carriage 12. The heat sinks 36, 136 can be directly connected to each other or, alternatively, connected to a portion of the carriage 12 which is sandwiched directly between the two heat sinks 36, 136. This provides the advantage of precisely locating the two print elements 20, 120 relative to each other even though they are two separate members and have their own separate and spaced ink tank receiving housings 18, 118. In a preferred embodiment the connection of the two print elements 20, 120 to each other is staggered or stepped relative to the front of the carriage 12 to provide a precise offset D, such as the length of 110 ink jets, between the front ends of the ink jet assemblies 40, 140. However, in alternate embodiments the offset D need not be provided or any suitable offset distance could be provided. In an alternate embodiment, the print element could be designed to have four ink tanks connected to it (one black and three color) and/or only one housing which can hold four or more ink tanks. The black ink could be replaced by three ink tanks; red-green-blue or low density inks for photographic printing. Thus, two of the three color print elements 120 could be used in a single device.

Referring now to FIG. 8A, the print element 20 can be used in a first type of printing device 200 without connecting the print element 20 to the housing 18. For example, the first type of printing device 200 could have an ink supply 202 which is spaced from the print element 20 and connected to the mount 74 by a supply conduit or tube 204. FIG. 8B illustrates that the same type of print element 20 can be mounted with the housing 18 at step 206 to form the print head 14 which is subsequently used to form the second different type of printing device 208 which can use rechargeable ink tanks mounted directly on the mount 74. During the assembly process at the manufacturing facility, the print head 20 can be manufactured on an assembly line and, with the additional optional additional step of mounting the housing 18 to the print element 20, the single assembly line can manufacture two different types of components for two different types of printing devices having different types of ink supply systems, but which use the same type of print elements. The present invention, by keeping the ink manifold assembly only on the print element and not using the housing 18 as part of the ink manifold, allows the print element to be tested and discarded if defective before connected to the housing 18. Thus, if the print element is defective, a housing 18 does not also need to be discarded because the housing has not been connected to the print element yet. The present invention could also include the print element being permanently attached to an ink supply with an integral housing to form a unitary ink supply and print head cartridge similar to the cartridge disclosed in U.S. Pat. No. 5,519,425. The same multiple use/configuration described above for the black ink print element 20 is equally applicable to the color ink print element 120.

Figure 9:
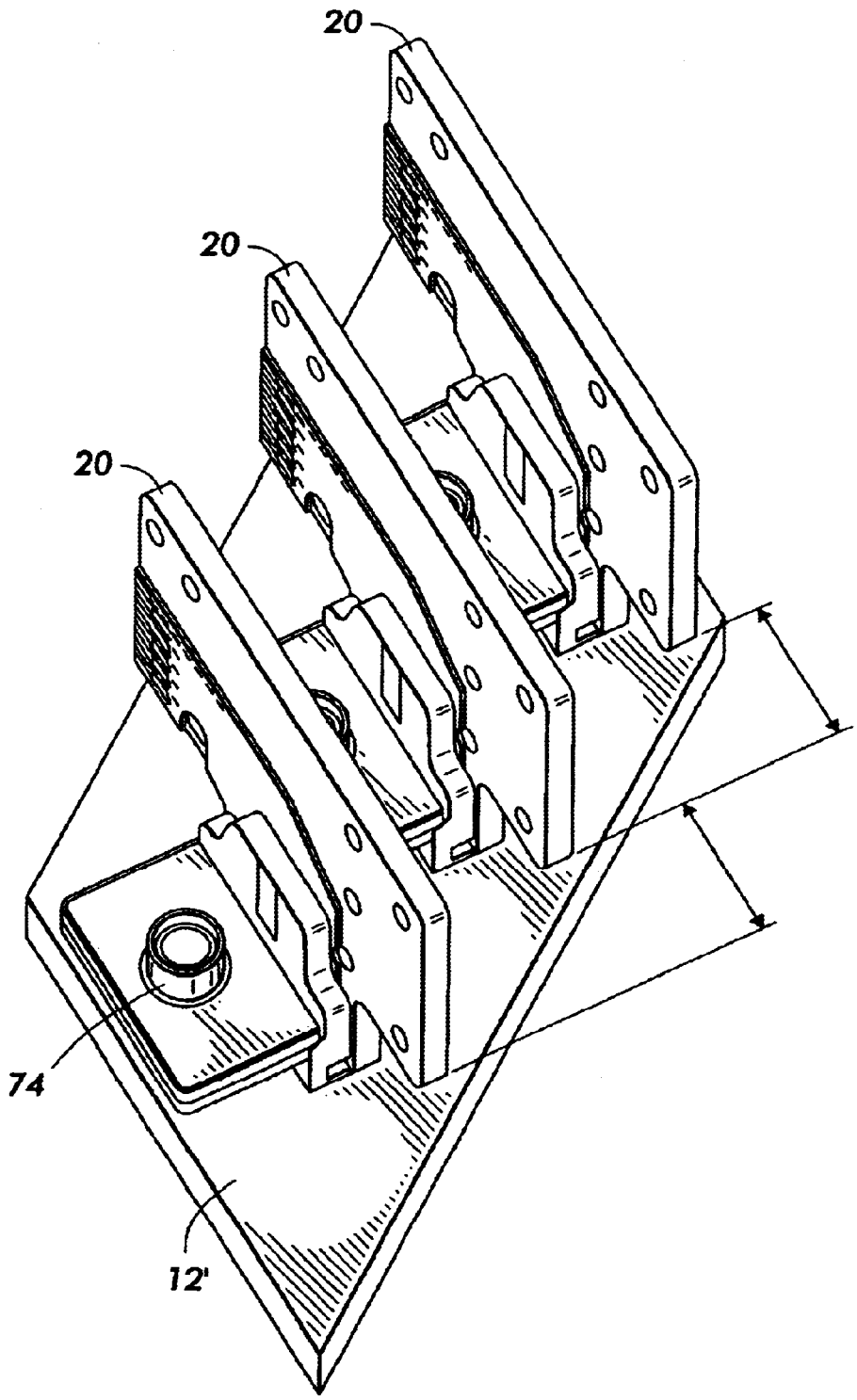
FIG. 9 is a schematic perspective view of three print elements being grouped or ganged together in a staggered or stepped configuration.
Figure 13:
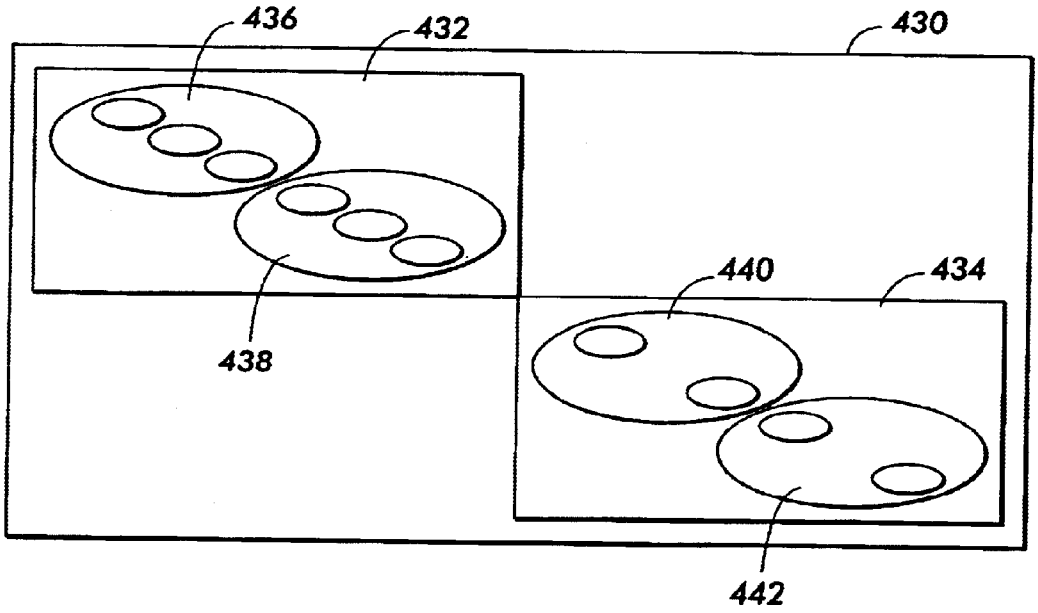

Referring now to FIG. 9, three of the print elements 20 are shown in a gang or grouped configuration. The three print elements 20 are mounted on a carriage 12' with the leading ends of their ink jet assemblies offset in a stepped configuration from the front edge of the carriage 12'. The mounts 74 would be connected to a single black ink source by three conduits (not shown). This type of ganging of the print elements 20 could be used in a device such as a plotter that prints on very large print medium, wherein ganging of the print elements in a stepped configuration can cover a larger area of the print medium in a single pass and thereby speed up printing. In alternate embodiments more or less than three of the same types of print elements can be ganged together, multiple gangs could be mounted on the same carriage, a print element and a gang or gangs of print elements could be on the same carriage, or multiple sets of one or more gangs of print elements could be on the same carriage. Any suitable grouping or configurations could be provided. Multiple carriages could also be provided. Some examples of these alternate embodiments are shown in FIGS. 11, 12, and 13. In FIG. 11, for example, the carriage 400 comprises three assemblies or gangs 402, 404, 406. The three gangs 402, 404, 406 each have three print elements 408, 409, 410; 411, 412, 413; and 414, 415, 416. The print elements 408–416 could be the same or different and could be connected to same color inks or grouped for connection to same color inks. For example, all the print elements 408–416 could be connected to one or more black ink sources. As another example, print elements 408, 411, 414 could be connected to one or more black ink sources and the rest of the print cartridges could be connected to color ink sources. As another example, the print elements in gang 402 could be connected to one color ink source, the print elements in gang 404 could be connected to a different color ink source, and the print elements in gang 406 could be connected to another different color ink source. FIG. 12 shows another example wherein a carriage 420 has an assembly or gang 422 of three print elements 424, 425, 426 and a print element 428 not directly ganged with the assembly 422. FIG. 13 shows another example wherein the carriage 430 has two assemblies 432, 434. Each assembly has two sub-assemblies 436, 438 and 440, 442, respectively. Each sub-assembly has one or more print element. These embodiments help to illustrate the modularity aspect of the print elements of the present invention. The printing device could also have more than one carriage.

Figure 10:
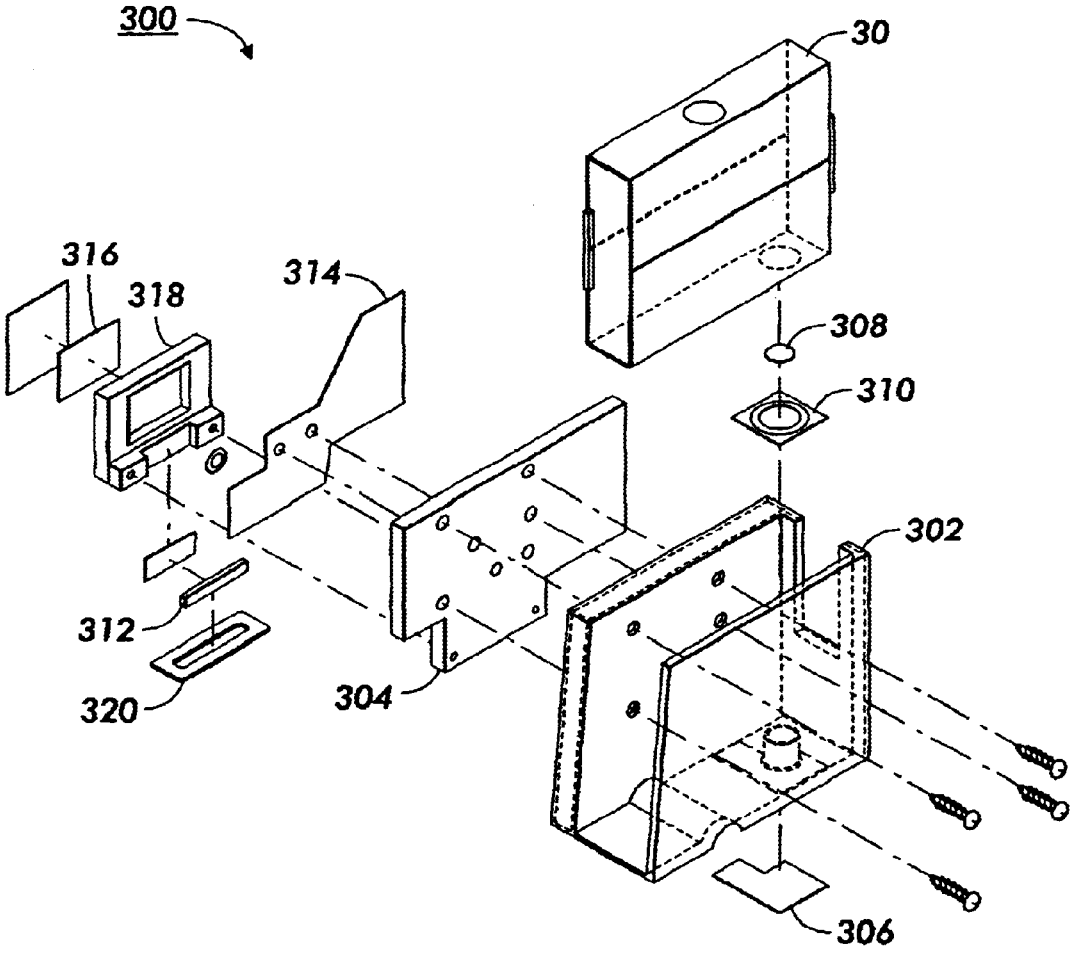
FIG. 10 is an exploded perspective view of an alternate embodiment of a print head having a dual ink manifold assembly.

Referring now to FIG. 10 an alternate embodiment of the black ink print head 300 is shown. In this embodiment the print head 300 includes a combined ink tank receiving housing and ink manifold member 302, a heat sink 304, a manifold cover 306, a coarse filter 308, a seal 310, an ink jet assembly 312, a printed wiring member 314, a fine filter 316, a manifold filter cover 318, and a faceplate 320. In this embodiment the ink tank 30 is mounted in the member 302 and ink is conduited through the member 302, to the fine filter 316 and manifold filter cover 318 on the opposite side of the heat sink 304. The ink is then delivered to the ink jet assembly 312. The ink jet assembly 312 is located on the opposite side of the heat sink 304 from the member 302. Thus, forces from loading the ink tank 30 into the member 302 are not directly transferred to the ink jet assembly 312. In addition, with this design heat can be stored in the ink and removed with drop ejection. With this type of design the ink jet assemblies could be located almost adjacent each other with only the manifold filter covers therebetween. This embodiment describes an ink jet cartridge which is made by joining two manifolds 318, 302. There are multiple purposes and advantages for the two manifold approach. The primary one is that the first manifold 318 can be placed on each die and different versions of the second manifold 302 can be designed for different product families. Also, the precision molded features can be contained in the smaller first manifold, thus providing tolerance relief and wider materials choice for the second larger manifold. An advantage is the ability to print test the die with the first manifold to find rejects before final assembly begins.

In the two manifold design, the ink tanks are inserted into the port manifold. The printer carriage rigidly holds the heat sink on the datums. Previous designs place the manifold against the die and heat sink with two point contact on the fluid seal and the third point on the manifold. This ensures that the fluid seal is properly compressed against the die and therefore provides a good seal. Ink tank insertion therefore applies stress to the fluid seal bond. The dual manifold design isolates the ink tank insertion to the heat sink side opposite the die 312 and, therefore, none of the ink tank insertion forces are applied to the fluid seal.

Also, since the fluid seal compression is not an issue with the port manifold, the port manifold can be grounded against the heat sink creating a more rigid package.

Due to the fine filter manifold small size, the part can be placed more accurately with smaller tolerances in the critical fluid seal area. The port manifold is added after the print element assembly is cured and therefore the port manifold does not see the high temperature cure cycles.

The ink jet fluid path has many requirements such as ink compatibility, flatness, low thermal expansion, and high deformation temperature that severely limit the material selection. The single manifold approach can require a large housing to be made from an expensive material that is difficult to process, which makes the molds extremely expensive and difficult to maintain. The overall part size makes it difficult to maintain the critical features. The dual manifold approach passes most of the requirements to the fine filter manifold. This manifold has the flatness and low thermal expansion requirements in the fluid seal area, and goes through the high temperatures required to cure the fluid seal. The two manifold approach actually eases the design requirements because the part is small and therefore a lot easier to hold the tight tolerances. The port manifold only has the ink compatibility requirement, and therefore has more material options, including materials that are 4–5 times cheaper per pound and a lot easier to process making the mold cheaper.

The print element assembly can be print tested as a stand alone unit. This has many advantages. First, if there is a failure and the unit is discarded, only the cost of the print element is lost, not the entire cost of the print cartridge. Second, after the print test, only the print element is required to be cleaned. The additional wetted area of the port manifold is not inked and therefore does not require cleaning. The fine filter ports also provide a convenient location for the print tester to connect to.

The present invention allows for a print cartridge design that is flexible enough to have either an onboard reservoir, a replaceable ink tank, or an external supply would have a high degree of reuse potential and synergy with a number of different products. An additional variation could allow for a head that has an integral ink supply to alternately accept an external ink supply.

The ultimate engineering feat would be to design a part that works in many applications. The proposal outlined here is to have a basic print element unit that can accept permanent ink tanks, removable ink tanks, or an external (perhaps tube fed) supply. The base printhead could be the same across all these product families, using common tooling.

The basic housing would incorporate all of the features necessary to attach to the print transducer as well as the required electrical interconnect. The lowest common ink delivery would be incorporated into this part. Through either mold inserts or separate parts, the options for the different feed mechanisms would be incorporated. The datum structures and tooling features would be developed off the base part so that the ink delivery variation would not impact the manufacture of the part.

A variation of this implementation, which is independent of it, is to allow for an ink tank supplied with ink to have an off head external supply connected to it. For example, a vent in the ink tank could allow for a feature to have a hose fitting from an external reservoir inserted or connected to it. This would allow customers with large graphics requirements to print large jobs without printhead replacement.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A print head comprising:

a housing having a receiving area for removably receiving at least one ink tank;

a print element connected to the housing, wherein the print element comprises an ink delivery nozzle, electrical conductors, and a manifold assembly mounted to the ink delivery nozzle for delivering ink to the nozzle, the manifold assembly having at least one mount for removably connecting the at least one ink tank to the manifold assembly, a heat sink connected to the ink delivery nozzle; and wherein the housing comprises an aperture through the housing and into the receiving area, wherein the heat sink is located at an exterior of the housing, and wherein the manifold assembly extends through the aperture into the receiving area such that the mount is located in the receiving area of the housing.

2. A print head as in claim 1 wherein the print element comprises a thermal ink jet assembly which includes the ink delivery nozzle.

3. A print head as in claim 1 wherein the print element comprises a printed wiring member which includes the electrical conductors.

4. A print head as in claim 1 wherein the aperture extends through a corner of the housing at a side wall and a bottom wall of the housing.

5. A print head as in claim 1 wherein the housing includes a resilient latch for removably mounting the ink tank to the housing.

6. A print head as in claim 5 further comprising a seal member mounted around the mount and having a resilient spring section for biasing the ink tank towards the resilient latch.

7. A print head as in claim 1 wherein a distal end of the manifold assembly, spaced from the heat sink, has a projection that extends to stabily locate the distal end relative to the housing or a printer carriage.

8. A print head as in claim 1 wherein the housing does not conduit ink, but merely comprises means for removably connecting the ink tank to the print element.

9. A print head assembly comprising:

a carriage; and two print heads connected to the carriage, each print head having a housing and a print element connected to the housing, each housing having a receiving area for removably receiving at least one ink tank, and each print element having an ink delivery nozzle and an ink manifold assembly mounted to the ink delivery nozzle, wherein a portion of each of the ink manifold assemblies are located in their respective housing receiving areas and the two print heads each include a heat sink which are each located at exterior sides of the respective housings and located between the two housings.

10. An assembly as in claim 9 wherein the two housings each comprise a hole therethrough and wherein the ink manifold assemblies project through the holes.

11. An assembly as in claim 9 wherein the heat sinks are directly connected to each other.

12. An assembly as in claim 9 wherein the portion of the ink manifold assemblies located in the receiving areas each comprise at least one mount for removably connecting the at least one ink tank to the ink manifold assemblies.

13. An assembly as in claim 12 wherein the ink manifold assemblies extend away from respective heat sinks of the print elements in a general perpendicular direction and the mounts extend in a general parallel direction relative to the heat sinks.

14. An assembly as in claim 9 wherein each housing includes at least one integrally formed resilient latch for mounting the at least one ink tank to the housings.

15. An assembly as in claim 14 further comprising a seal member in each of the housing receiving areas, each seal member having a resilient spring section for biasing the at least one ink tank towards the resilient latches.

* * * * *